United States Patent [19]

Zoleski et al.

[11] 4,375,417

[45] Mar. 1, 1983

[54] CYLINDER LUBRICATING OIL COMPOSITION

[75] Inventors: Benjamin H. Zoleski, Beacon; Rodney L. Sung; William P. Cullen, both of Fishkill, all of N.Y.

[73] Assignee: Texaco Inc., White Plains, N.Y.

[21] Appl. No.: 315,570

[22] Filed: Oct. 27, 1981

[51] Int. Cl.[3] ..... C10M 1/40

[52] U.S. Cl. ..... 252/33.4; 252/51.5 A; 252/51.5 R

[58] Field of Search ..... 252/33.4, 51.5 A, 51.5 R

[56] References Cited

U.S. PATENT DOCUMENTS

| | | | |
|---|---|---|---|
| 3,368,971 | 2/1968 | Retzloff et al. | 252/33.4 |
| 4,253,973 | 3/1981 | Horodysky et al. | 252/51.5 A |
| 4,256,592 | 3/1981 | Gemmill et al. | 252/32.7 E |
| 4,266,944 | 5/1981 | Sung | 44/63 |

*Primary Examiner*—Jacqueline V. Howard

[57] ABSTRACT

A cylinder lubricating oil composition characterized by having a Total Base Number from about 50 to 100 comprising a mineral lubricating oil, from 10 to 20 percent of an overbased calcium sulfonate and at least one acyl glycine oxazoline derivative having the formula:

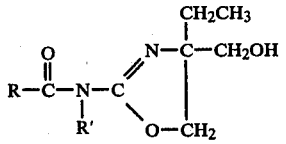

where R is lauryl, $C_{11}H_{23}$, oleyl or stearyl; and R' is hydrogen or lower alkyl.

12 Claims, No Drawings

CYLINDER LUBRICATING OIL COMPOSITION

BACKGROUND OF THE INVENTION

1. Field of the Invention

This invention relates to cylinder lubricating oils containing acyl glycine oxazolines acting as friction reducing agents.

Energy costs are especially burdensome to the users of transportation fuels, such as shipowners. These major consumers of petroleum products are reacting to these events and are searching for more efficient measures to use in their operations. One significant development in the shipping field is the trend away from steam turbine propulsion units in favor of large marine diesel engines which are more fuel efficient with respect to petroleum fuels.

Currently, the largest marine diesel engines used for ship propulsion are classified as slow speed marine diesel engines. These engines are unique both in their size and in their method of operation. The engines themselves are massive, the larger units approaching 2000 tons in weight and upwards of 100 feet long and 45 feet in height. Their output can reach 50,000 brake horsepower with engine revolutions ranging from about 100 to 125 revolutions per minute.

The slow speed marine diesel engines are also unique in their design. Most notably, the crankcase of the large slow speed single acting 2 stroke crosshead type of engine is completely separate from the combustion chambers of the engine. Because of this, its lubrication requirement differs from that of a typical diesel engine. In particular, the upper cylinder portion of the slow speed diesel engine, not being in direct communication with the crankcase zone of the engine, has its own lubrication system with specific lubrication requirements that differ markedly from the requirements of a crankcase lubricant. In addition, and for reasons of economy, the fuel employed to run the large slow speed diesel engines are residual fuels having relatively high levels of sulfur. This circumstance dictates the employment of a highly overbased lubricating oil composition in order to counteract the acidity generated during the combustion of the sulfur-containing fuel. As a result, a typical cylinder lubricating oil composition for a slow speed marine diesel engine will have an alkalinity level expressed as total base number ranging between about 50 and 100.

The fuel consumption rate of a marine diesel engine of 30,000 horsepower ranges upwards of 1200 gallons of fuel per hour. In view of the current need to reduce overall oil consumption, intensive efforts are being made to discover lubricating oil compositions which can materially reduce the friction losses which take place within the engine itself. Reductions in engine friction losses translate directly into significant fuel savings.

Numerous means have been employed to reduce the friction in internal combustion engines. These range from the use of lower viscosity lubricating oils or mixtures of mineral and synthetic lubricating oils as well as to the incorporation of friction-reducing additives such as graphite, molybdenum compounds and other chemical additives. There are limits to the extent to which the viscosity of a lubricating oil can be reduced for the purpose of reducing friction. Generally, a lubricating oil having too light a viscosity will fail to prevent metal-to-metal contact during high load operating conditions with the result that unacceptable wear will occur in the engine. With respect to chemical anti-friction additives, significant research efforts are ongoing to find effective and economic anti-friction additives which exhibit stability over an extended service life and under a wide range of operating conditions.

It is an object of this invention to provide a novel cylinder lubricating oil composition for a slow speed marine diesel engine.

It is another object of this invention to provide a highly overbased marine cylinder lubricating oil having improved friction properties for lubricating a slow speed marine diesel engine.

2. Description of Prior Disclosures

Coassigned U.S. Pat. No. 4,266,944 issued May 12, 1981 to R. L. Sung describes and claims the instant acyl glycine oxazolines and their use as detergents in gasoline. Heretofore, experience has shown that ineffective gasoline detergents may be effective as friction reducers in oils and vice versa so that the performance of the present compounds in oils was totally unexpected.

U.S. Pat. No. 3,116,252 issued Dec. 31, 1963 to H. S. Beretvas describes a rust inhibiting composition for lubricants consisting of a mixture of an acyl sarcosine, a 1,2-disubstituted imidazoline and an alkylene oxide rosin amine reaction product.

The disclosures of the U.S. patents noted above are incorporated herein by reference.

As will be seen hereinafter, neither of these disclose in any manner Applicants' invention.

SUMMARY OF THE INVENTION

The cylinder lubricating oil composition of this invention comprises a lubricating oil, an overbased calcium sulfonate having a Total Base Number from 300 to 450 in an amount sufficient to impart a total base number ranging from about 50 to 100 to the lubricating oil composition and a minor amount of an acyl glycine oxazoline derivative represented by the formula:

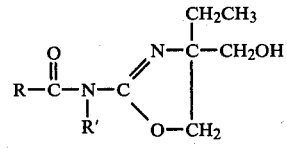

where R is lauryl, $C_{11}23$, oleyl or stearyl; and R′ is hydrogen or lower alkyl ($C_1$–$C_5$).

The novel method of the invention involves operating a slow speed marine diesel engine by supplying the above-described lubricating oil composition to the upper cylinder lubrication system of said engine.

SPECIFIC EMBODIMENTS OF THE INVENTION

In a more specific embodiment of the invention, the cylinder lubricating composition of the invention will comprise at least 80 weight percent of a mineral lubricating oil, from about 10 to 20 weight percent of an overbased calcium sulfonate sufficient to impart a total base number to the lubricating oil composition ranging between about 50 and 100 and a minor friction modifying amount of at least one acyl glycine oxazoline derivative having the formula:

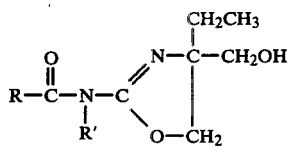

where R is lauryl, $C_{11}H_{23}$, oleyl or stearyl; and R' is hydrogen or lower alkyl. Preferably R and R' taken together contain from 13 to 21 carbon atoms.

Preferably, both the R and R' radicals are straight chain; however, they also can be branched and may be substituted with one or more non-interfering substituents such as halogen, cyano, trifluoromethyl, nitro or alkoxy.

Preferred friction modifying components of the lubricating oil composition of the invention are those where R is lauryl or oleyl.

In general, the compounds of the invention are synthesized as described in U.S. Pat. No. 4,266,944 by reacting a 2-amino-2-(lower)alkyl-1,3 propanediol with an N-acyl sarcosine in an inert solvent, preferably xylene, refluxing the reaction mixture for about 8 hours to remove by azeotroping the xylene and the water of reaction; filtering and stripping the filtrate under vacuum to isolate the product. The reaction proceeds as follows:

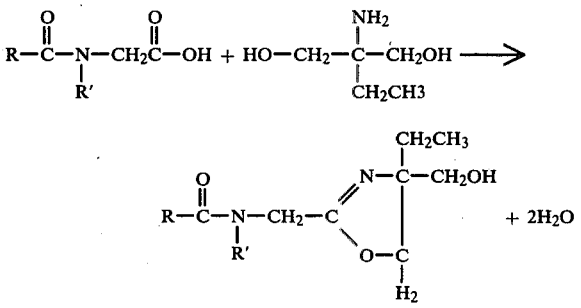

Where R and R' are as above.

N-acyl sarcosines suitable as reactants include lauroyl sarcosine, cocoyl sarcosine, oleoyl sarcosine, stearoyl sarcosine and other fatty sarcosines containing from 8 to 22 carbon atoms. The preferred propanediol is 2-amino-2-ethyl-1,3-propanediol.

The following examples illustrate the best mode of making and using the friction reducing additive component of the cylinder oil composition of the invention.

EXAMPLE I

Synthesis of Oxazoline of Sarkosyl O

A mixture of 0.7 mole of oleyl sarcosine and 0.7 mole of 2 amino-2-ethyl 1,3 propanediol in 600 parts of xylene was refluxed & water of reaction was azeotroped over. After 8 hours of reflux, the reaction mixture was cooled and filtered, then stripped under vacuum. The residue was analyzed by I. R. and elemental analysis.

EXAMPLE II

A mixture of 0.7 mole of lauroyl sarcosine and 0.7 mole of 2-amino-2-ethyl,1,3 propanediol in 600 ml. of xylene was refluxed and water of reaction was azeotroped over. At the end of 8 hours, the reaction was stripped, filtered, and stripped under vacuum. The residue was analyzed by I.R. and elemental analysis.

EXAMPLE III

A mixture of 0.7 mole of cocoyl sarcosine and 0.7 mole of 2-amino-2-ethyl-1,3-propanediol is reacted as in Example I to give the oxazoline of cocoyl sarcosine.

EXAMPLE IV

A mixture of 0.7 mole of stearyl sarcosine and 0.7 mole of 2-amino-2-ethyl-1,3-propanediol is reacted as in Example I to give the oxazoline of stearyl sarcosine.

The friction modifying component of the cylinder lubricating oil composition of the invention is effective in a range from about 0.2 to 5 weight percent based on the total lubricating oil composition. In general, it is preferred to employ from about 0.5 to 2 weight percent of the oxazoline derivative with the most preferred concentration ranging from about 0.75 to 1.5 weight percent.

The second essential component of the cylinder lubricating oil composition of the invention is an overbased calcium sulfonate having a Total Base Number ranging from 300 to 450 on an active material or neat basis. This component is employed in the finished cylinder lubricating oil at a concentration ranging from 10 to 20 weight percent based on the weight of the lubricating oil composition and sufficient to provide a cylinder lubricating oil having a Total Base Number from about 50 to 100. A preferred overbased calcium sulfonate has a TBN ranging from about 350 to 425, a preferred concentration of the sulfonate in the lubricating oil is from about 12 to 18 weight percent and a preferred TBN for the lubricating oil composition is from 60 to 80. Total Base Number (TBN) is a measure of alkalinity determined according to the test procedure outlined in ASTM D-664.

Overbased calcium sulfonates can be derived from sulfonic acids or particularly from petroleum sulfonic acids or alkylated benzene sulfonic acids. Useful sulfonic acids from which the overbased calcium sulfonates are prepared can have from about 12 to 200 carbon atoms per molecule. Examples of specific sulfonic acids include mahogany sulfonic acid, petrolatum sulfonic acids, aliphatic sulfonic acids and cycloaliphatic sulfonic acids. Particularly useful alkylated benzene sulfonic acids include polybutylbenzene sulfonic acid, polypropylbenzene sulfonic acid and copolymer propyl 1-butylbenzene sulfonic acids having molecular weights ranging from about 400 to about 900.

The overbased calcium sulfonates are produced by neutralizing the sulfonic acid with a calcium base to form a calcium sulfonate salt and then overbasing the calcium sulfonate with calcium carbonate generally by passing carbon dioxide through a mixture of the neutral calcium sulfonate, mineral oil, lime and water. Methods for preparing overbased calcium sulfonates are disclosed in U.S. Pat. Nos. 3,779,920 and 4,131,551 and the disclosures in these references are incorporated herein by reference.

The hydrocarbon base oil which can be employed to prepare the cylinder lubricating oil composition of the invention includes naphthenic base, paraffinic base and mixed base mineral oils, lubricating oil derived from coal products and synthetic oils, e.g., alkylene polymers such as polypropylene and polyisobutylene of a molecular weight of between about 250 and 2500. Advantageously, a lubricating base oil having a lubricating oil viscosity SUS at 100° F. of between about 50 and 1500, preferably between about 100 and 1200, are normally employed for the lubricant composition. The most preferred lubricating viscosity for a cylinder lubricating oil composition is a viscosity ranging from about 68 to 108 SUS at 210° F. The hydrocarbon oil will generally constitute from about 80 to 90 weight percent of the total lubricating oil composition with the preferred concentration range being from about 82 to about 88 weight percent.

The improvement in fuel economy brought about by the novel cylinder lubricant composition of the invention was demonstrated in the Small Engine Friction Test. The Small Engine Friction Test (SEFT) uses a single cylinder, air-cooled, 6-horsepower engine driven by an electric motor. The engine has a cast-iron block and is fitted with an aluminum piston and chrome-plated rings. The electric motor is cradle-mounted so that the reaction torque can be measured by a strain arm. The engine is housed in a thermally insulated enclosure with an electric heater and is driven at 2000 rpm.

Prior to each test, the engine is flushed three times with 1-quart charges of test oil. During the test run, the engine and oil temperatures are increased continually from ambient until a 280° F. oil temperature is reached. The heat comes from engine friction, air compression work and from the electric heater. The engine and oil temperatures and the engine motoring torque are recorded continually during the test. A SEFT run takes about 4 hours. Each test oil evaluation is preceded by a run on a reference oil for a like period of time. The torque reference level for the engine shifts very slowly with time as a result of engine wear. Therefore, the test oil results were recorded compared to a reference band consisting of data from up to three reference runs made before and three runs made after the test oil evaluation.

The frictional effects of the novel cylinder lubricating oil composition of the invention containing the prescribed oxazoline friction modifier was evaluated in a commercial marine cylinder lubricating oil composition. The commercial lubricant or base oil and the modified oil containing the friction modifier of the invention were tested for the friction properties in the Small Engine Friction Test described above. The oil compositions and the test results are set forth in the table below:

EXAMPLE V

TABLE I

SMALL ENGINE FRICTION TEST RESULTS OF 70 TBN MARINE CYLINDER OIL

| Composition, Vol. % | Marine Cylinder Oil (Base Oil) | Modified Marine Cylinder Oil |
|---|---|---|
| Solvent Neutral Oil - SUS at 100° F. of 845 | 38.338 | 37.338 |
| Bright Stock 145, 135–145 SUS at 212° F. | 16.300 | 16.300 |
| 75/80 Pale Oil, 70–77 SUS at 212° F. | 31.550 | 35.550 |
| Overbased calcium sulfonate 400 TBN | 13.800 | 13.800 |
| Corrosion Inhibitor | 0.012 | 0.012 |
| Silicone Antifoamant, ppm | 150 | 150 |
| Product of Example I | — | 1.000 |
| Small Engine Friction Engine Motoring Torque, Ft. Lbs. at 280° F. | 3.20 | 2.63 |
| Frictional Improv. Overbased Oil, % | — | 21.7 |

(1) Provides 3.0 wt. % Calcium

The foregoing example illustrates the realization of a 21.7 percent reduction in the frictional properties of high TBN marine cylinder oil due to the presence of the sarkosyl O oxazoline.

EXAMPLE VI

A marine cylinder oil is prepared by adding 0.2 weight percent of the product of Example II to the marine cylinder base oil of Example V.

EXAMPLE VII

A friction modified marine cylinder oil is prepared by adding 0.5 percent of the product of Example III to the marine cylinder base oil of Example V.

EXAMPLE VIII

A marine cylinder oil is prepared by adding 2 weight percent of the product of Example II to the marine cylinder base oil of Example V.

The foregoing examples illustrate a highly overbased marine cylinder lubricating oil composition for a large slow speed diesel engine which exhibits a substantial improvement in friction properties due to use of the prescribed oxazoline derivatives.

We claim:

1. A cylinder lubricating oil composition having a Total Base Number in the range from about 50 to 100 comprising a mineral lubricating oil, from about 10 to 20 weight percent of an overbased calcium sulfonate having a Total Base Number from about 300 to 450, and a friction modifying amount of at least one oxazoline derivative of the formula:

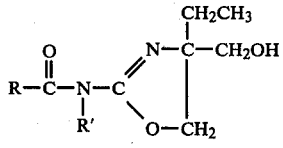

where R is lauryl, $C_{11}H_{23}$, oleyl or stearyl; R′ is hydrogen or (lower) alkyl.

2. A cylinder lubricating oil composition according to claim 1 in which R and R′ in said derivative contain from 13 to 21 atoms.

3. A cylinder lubricating oil composition according to claim 1 containing from about 12 to 18 percent of an overbased calcium sulfonate having a Total Base Number ranging from 350 to 425.

4. A cylinder lubricating oil composition according to claim 1 containing from about 0.2 to 5 weight percent based on said lubricating oil composition of said derivative.

5. A cylinder lubricating oil composition according to claim 1 having a Total Base Number ranging from about 60 to 80.

6. A cylinder lubricating oil composition according to claim 1 in which said overbased calcium sulfonate is derived from petroleum sulfonic acids or alkylated benzene sulfonic acids having from about 12 to 200 carbon atoms per molecule.

7. A cylinder lubricating oil composition according to claim 1 in which the concentration of said derivative ranges from about 0.5 to 2.0 weight percent.

8. A cylinder lubricating oil composition according to claim 1 in which the concentration of said oxazoline derivative ranges from about 0.75 to 1.5 weight percent.

9. The composition of claim 1 wherein said derivative is the oxazoline of oleyl sarcosine.

10. The composition of claim 1 wherein said derivative is the oxazoline of lauroyl sarcosine.

11. The composition of claim 1 wherein said derivative is the oxazoline of cocoyl sarcosine.

12. The composition of claim 1 wherein said derivative is the oxazoline of stearoyl sarcosine.

* * * * *